US009587444B2

(12) United States Patent
Agarwal

(10) Patent No.: US 9,587,444 B2
(45) Date of Patent: Mar. 7, 2017

(54) DAMPENER LUBRICATOR FOR PLUNGER LIFT SYSTEM

(71) Applicant: Weatherford Technology Holdings, LLC, Houston, TX (US)

(72) Inventor: Manish Agarwal, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 463 days.

(21) Appl. No.: 14/137,145

(22) Filed: Dec. 20, 2013

(65) Prior Publication Data

US 2015/0176377 A1 Jun. 25, 2015

(51) Int. Cl.
*E21B 17/07* (2006.01)
*E21B 43/12* (2006.01)

(52) U.S. Cl.
CPC ..... *E21B 17/07* (2013.01); *E21B 43/121* (2013.01)

(58) Field of Classification Search
CPC ..... E21B 17/07; E21B 43/121; E21B 33/068; F16F 7/09; F16F 9/14; F16F 9/16; F16F 9/18; F16F 9/3214; F16F 9/3405
USPC ..... 267/64.11, 64.13, 64.15
See application file for complete search history.

(56) References Cited

U.S. PATENT DOCUMENTS 3,024,875 A * 3/1962 Stultz ..... F16F 9/092 188/269
3,215,426 A * 11/1965 Engels ..... F41A 9/54 104/256
4,192,380 A 3/1980 Smith
4,532,856 A * 8/1985 Taylor ..... F15B 15/1438 188/322.17
6,333,699 B1 12/2001 Zierolf
6,595,287 B2 7/2003 Fisher
7,063,148 B2 6/2006 Jabusch
7,337,854 B2 3/2008 Horn et al.
7,387,165 B2 6/2008 Lopez de Cardenas et al.
7,878,242 B2 2/2011 Gray
8,479,808 B2 7/2013 Gouthaman
8,485,263 B2 7/2013 Lembcke
8,505,632 B2 8/2013 Guerrero et al.
2006/0108126 A1* 5/2006 Horn ..... F04B 47/12 166/105
2012/0067594 A1 3/2012 Noske et al.

* cited by examiner

*Primary Examiner* — David Andrews
*Assistant Examiner* — Manuel C Portocarrero
(74) *Attorney, Agent, or Firm* — Patterson & Sheridan, LLP

(57) ABSTRACT

A lubricator for use in a plunger lift system includes a tubular body having an outlet formed through a wall thereof and a bore therethrough. The bore is closed at an end thereof. The lubricator further includes a striker assembly disposed within the bore. The striker assembly includes a dampener housing longitudinally movable relative to the tubular body between a ready position and a stroked position and a choke plate. The choke plate: is disposed in the dampener housing, separates a bore of the housing into an upper hydraulic chamber and a lower hydraulic chamber, and has one or more orifices formed therethrough. The striker assembly further includes a dampener support rod connecting the choke plate to the tubular body. The orifices are sized to dissipate kinetic energy of a plunger striking a lower end of the dampener housing.

16 Claims, 5 Drawing Sheets

DAMPENER LUBRICATOR FOR PLUNGER LIFT SYSTEM

BACKGROUND OF THE INVENTION

Field of the Invention

The invention generally relates to a dampener lubricator for a plunger lift system.

Description of the Related Art

To obtain hydrocarbon fluid from an earth formation, a wellbore is drilled into the earth to intersect an area of interest, such as a hydrocarbon-bearing reservoir, within a formation. The wellbore may then be "completed" by inserting casing within the wellbore and setting the casing therein using cement. In the alternative, the wellbore may remain uncased (an "open hole wellbore"), or may become only partially cased. Regardless of the form of the wellbore, production tubing is typically run into the wellbore (within the casing when the well is at least partially cased) primarily to convey production fluid (e.g., hydrocarbon fluid, which may also include water) from the reservoir within the wellbore to the surface of the wellbore.

Often, pressure within the wellbore is insufficient to cause the production fluid to naturally rise through the production tubing to the surface of the wellbore. Thus, to carry the production fluid from the reservoir within the wellbore to the surface of the wellbore, an artificial lift system is sometimes necessary. Some wells are equipped with a plunger lift system to artificially lift production fluid to the surface of the wellbore.

A plunger lift system generally includes a piston, often termed a "plunger," which cyclically travels the length of the production tubing. The plunger acts as a free piston to provide a mechanical interface between lifted gas from the formation disposed below the plunger and the produced fluid disposed above the plunger, thus increasing the lifting efficiency of the well.

Once the fluid is lifted by the plunger, it flows upward through the production tubing until it reaches surface equipment. The surface equipment includes a lubricator for absorbing the shock of force exerted by the upwardly-moving plunger at the end of the plunger's up-stroke. During the plunger cycle, the plunger runs within the bore of the production tubing for the full length of the production tubing between a lower bumper spring and the lubricator.

FIG. 1 shows a typical lubricator 100 having an upper end 101 and a lower end 102. The lubricator 100 includes a tubular body having a first tubular section 103, usually termed a "spring housing," connected to a second tubular section 104. Seals, such as o-rings 105, are provided at the connection point between the tubular sections 103, 104 to prevent fluid communication between a bore 108 of the lubricator 100 and the atmosphere. A cap 130 is connected to an upper end of the spring housing 103.

First and second flow outlets 110, 120 and a catcher assembly 140 extend from the tubular body. The catcher assembly 140 retains the plunger to facilitate inspection of the plunger. Handles 135 also extend from the first tubular section 103 to permit lifting of the lubricator 100. At an upper portion of the tubular body, the lubricator 100 includes an upper bumper spring 109 within the bore 108 to attempt to absorb the shock or kinetic energy of a plunger at the end of a plunger up-stroke. A bumper plate 106, which is disposed within the bore 108 directly below the upper bumper spring 109, provides a solid contact point for the plunger. The bumper plate 106 includes an opening 107 which allows fluid communication between the portions of the bore 108 above and below the bumper plate 106.

Using the bumper spring 109 within the lubricator to absorb the shock of the plunger on the plunger up-stroke is problematic for several reasons. First, the force of impact of the plunger against the spring often causes the bumper spring to fail, break, or become otherwise damaged. Damage to the spring may require replacement of the spring, decreasing the profits of the well because of down-time during spring replacement. Additionally, damage to the spring may decrease the shock absorption ability of the spring, eventually causing the plunger to blow out the cap and exit the lubricator into the atmosphere. Blowing off the cap from the lubricator creates a safety hazard and usually causes damage to the lubricator, also decreasing the profitability of the well due to down-time to replace or repair the lubricator. Additionally, damage to the spring may cause damage to the plunger upon impact with the striker assembly due to ineffective or non-existent cushioning of the plunger. The damaged spring increases operating costs of the well not only because of down-time which occurs to replace or repair the plunger, but also because of the additional cost of replacement parts.

Therefore, there is a need for a lubricator having an improved ability to cushion the plunger at or near the end of the up-stroke of the plunger.

SUMMARY OF THE INVENTION

The invention generally relates to a dampener lubricator for a plunger lift system. In one embodiment, a lubricator for use in a plunger lift system includes a tubular body having an outlet formed through a wall thereof and a bore therethrough. The bore is closed at an end thereof. The lubricator further includes a striker assembly disposed within the bore. The striker assembly includes a dampener housing longitudinally movable relative to the tubular body between a ready position and a stroked position and a choke plate. The choke plate is disposed in the dampener housing, separates a bore of the housing into an upper hydraulic chamber and a lower hydraulic chamber, and has one or more orifices formed therethrough. The striker assembly further includes a dampener support rod connecting the choke plate to the tubular body. The orifices are sized to dissipate kinetic energy of a plunger striking a lower end of the dampener housing and moving the dampener housing from the ready position to the stroked position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the present invention generally provide a lubricator capable of sufficiently cushioning a plunger of a plunger lift system when the plunger approaches and/or reaches the end of plunger up-stroke within the plunger lift system. Lubricators characteristic of embodiments of the present invention provide a safer plunger lift system which is less prone to damage. Increasing the safety of the lubricator and decreasing the damage to components of the lubricator and the plunger lift system advantageously reduces the operating costs of the well, reduces well downtime, and increases operational safety of the well.

Figure 1:
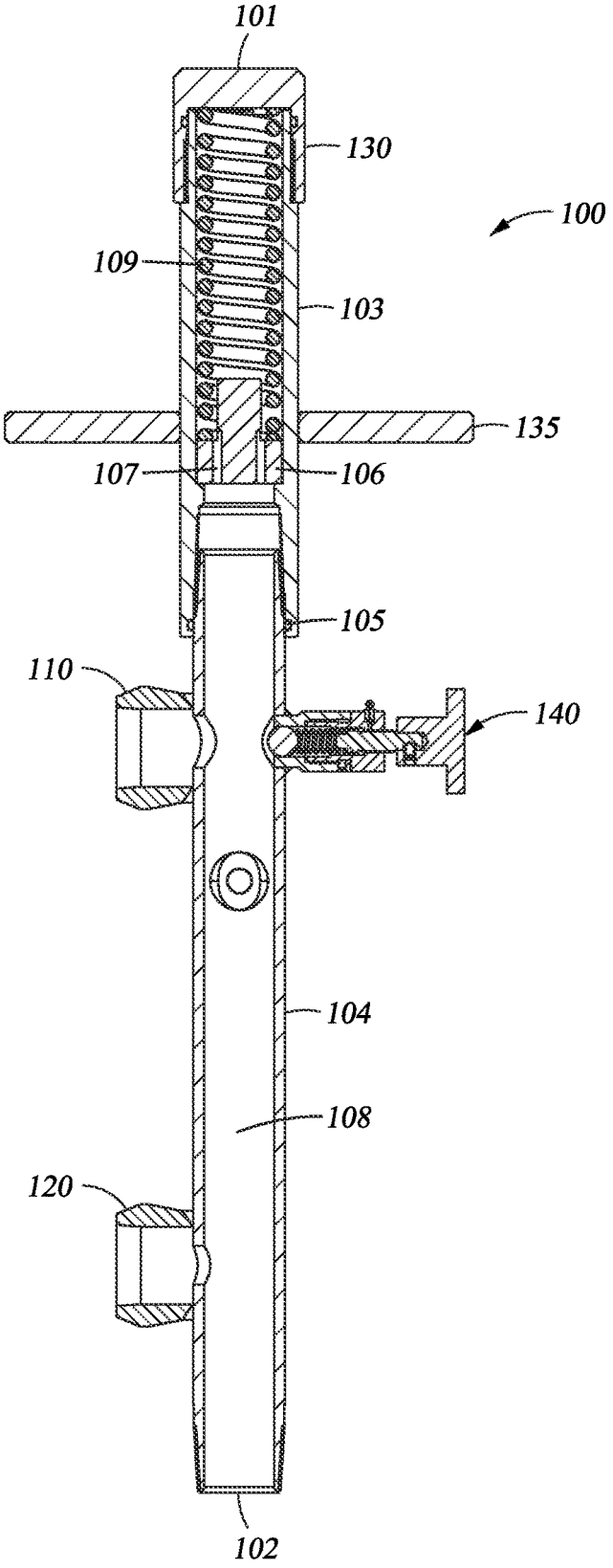
Fig. 1 (PRIOR ART)
FIG. 1 illustrates a conventional lubricator.
Figure 2:
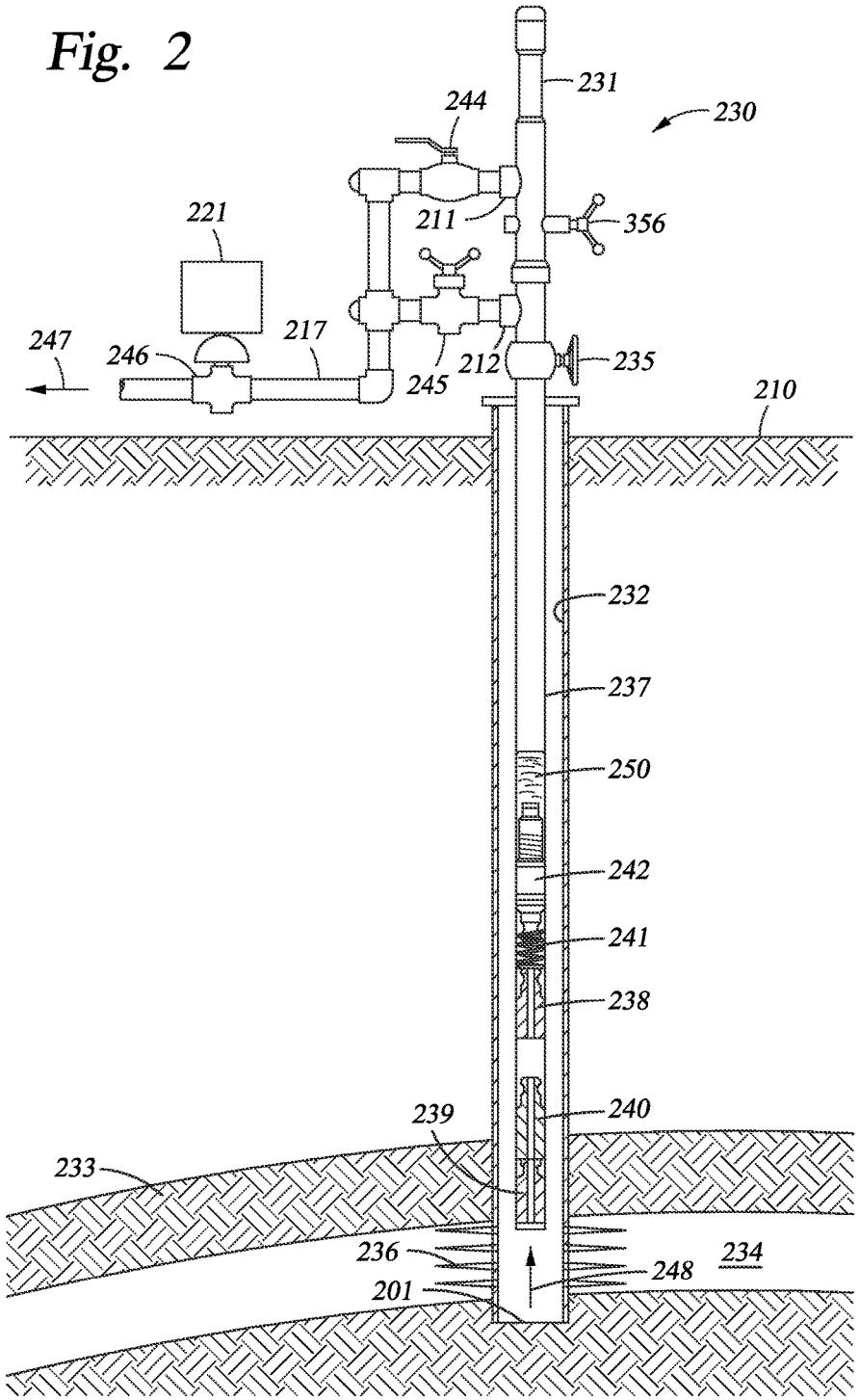
FIG. 2 illustrates a plunger lift system, according to one embodiment of the invention.

FIG. 2 illustrates a plunger lift system 230 according to one embodiment of the invention. A wellbore 201 has been drilled from a surface 210 of the earth 233 into a hydrocarbon-bearing (i.e., crude oil and/or natural gas) reservoir 234. A string of casing 232 has been run into the wellbore 201 and set therein with cement (not shown). The casing 232 has been perforated 236 to provide to provide fluid communication between the reservoir 234 and a bore of the casing string 232. A wellhead has been mounted on an end of the casing string 232. A string of production tubing 237 extends from the wellhead to the reservoir 234 to transport production fluid 248 from the reservoir 234 to the surface 210. The reservoir 234 may initially be naturally producing and may deplete over time to require an artificial lift system (ALS) to maintain production.

The plunger lift system 230 may include a lubricator 231, a plunger 242, the production tubing 237, and a bottomhole assembly. The plunger 242 is utilized to obtain the production fluid 248 from the reservoir 234 by delivering a load 250 of fluid to the surface 210. If the production fluid 248 is primarily natural gas, the fluid load 250 may be water and/or condensate which would otherwise hamper production. If the production fluid 248 is primarily crude oil, the fluid load 250 may be a slug of crude oil.

The bottom hole assembly may be disposed proximate a lower end and within a longitudinal bore of the production tubing 237. The bottomhole assembly may include upper and lower tubing stops 238, 239 having a standing valve 240 therebetween. A lower bumper spring 241 is located above the upper tubing stop 238, and the plunger 242, which facilitates fluid lift, is disposed above the lower bumper spring 241. The lower bumper spring 241 and the tubing stop 238 provide a shock absorber at the lower end of the production tubing 237 to cushion the plunger 242 at the end of plunger down-stroke.

The standing valve 240 may be a separate component from the lower tubing stop 239 and the lower bumper spring 241. Alternatively, the standing valve 240, lower tubing stop 239, and lower bumper spring 241 may constitute one assembly. In other configurations, two or more of the standing valve 240, lower tubing stop 239, and lower bumper spring 241 may be combined with one another to constitute a portion of the bottomhole assembly. In either case, the lower bumper spring 241 may have a ball and seat integrated therewith.

The lubricator 231 may be installed on top of a master valve 235 connected to the wellhead. An upper fluid flow outlet 211 provides an exit path for the fluid load 250 and a lower fluid outlet 212 provides an exit path for the production fluid 248. The upper fluid flow outlet 211 and the lower fluid flow outlet 212 may be selectively opened and closed by respective shutoff valves 244, 245. Both fluid flow outlets 211, 212 merge into a single flow line 217 through which flow is controlled via an automated valve 246. An electronic controller 221, such as a programmable logic controller (PLC) or microcontroller, may operate the automated valve 246. The automated valve 246 may be a shutoff valve or variable choke valve.

During operation, the plunger 242 cycles between a striker assembly of the lubricator 231 and the lower bumper spring 241 of the bottomhole assembly. The bumper spring 241 absorbs the shock or kinetic energy of the plunger 242 at the end of the down-stroke of the plunger lifting cycle. The fluid load 250 is lifted upward toward the surface 210 by the plunger 242 to facilitate production of the reservoir 234.

Near or at the end of the plunger down-stroke, the plunger 242 picks up the fluid load 250 removed from the reservoir 234. At the lowermost point of travel of the plunger 242, the plunger 242 contacts the bumper spring 241. The bumper spring 241 decreases the kinetic energy of the plunger 242, stops the movement of the plunger 242, and reverses the direction of the plunger 242 so that the plunger 242 travels upward within the bore of the production tubing 237.

The plunger 242 then travels upwards through the bore of the master valve 235 and into the bore of the lubricator 231, thereby discharging the liquid load 250 into the upper outlet 211 while the production fluid 248 is discharged from the lower outlet 212, thereby forming a combined fluid 247 at an outlet of the automated valve 246. A catcher assembly 356 may be operated to retain the plunger 242 in the lubricator 231 to allow continued production from the reservoir 234, the plunger may be retained in the lubricator by keeping the automated valve 246 open, or the plunger 242 may be allowed to fall back to the bottomhole assembly to repeat the cycle by closing the automated valve.

Figure 3:
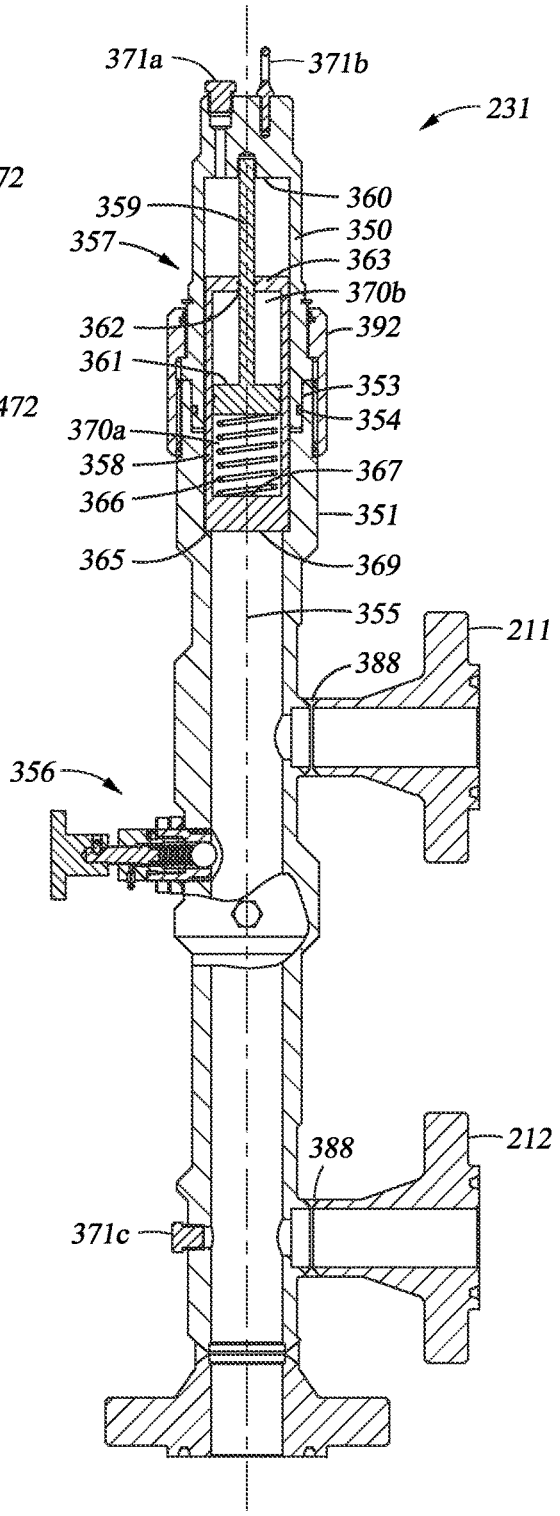
FIG. 3 illustrates a lubricator of the plunger lift system.

FIG. 3 illustrates the lubricator 231. The lubricator 231 may include a tubular body having one or more sections, such as an upper body section 350 and a lower body section 351 connected at a joint 353. The joint 353 may be include one or more seals, such as o-rings 354, to isolate the joint. The joint 353 may be fastened together by a nut 392 engaged with a threaded coupling formed in an upper end of the lower body section 351 and a shoulder formed in an outer surface of the upper body section 350. The lower body section 351 may have a flange for connection to the master valve 235, thereby connecting the lubricator 231 to a downhole portion of the plunger lift system 230. A longitudinal bore 355 extends through the upper body section 350 and lower body section 351 of the lubricator 231. The upper section 350 may have a cap portion 360 closing the bore 355.

The upper fluid outlet 211 and lower fluid outlet 212 may each extend from the lower body section 351. Each fluid outlet 211, 212 may include a flange connected to the lower body section 351, such as by a weld 388. Alternatively, the lubricator 231 may instead include only one fluid flow outlet. When only a single flow outlet exists, a flow tee may be utilized to change an existing single flow outlet into a dual flow outlet.

The lubricator 231 may further include one or more sensors, such as a pressure transducer 371*a* in fluid communication with an upper portion of the lubricator, a pressure transducer 371*b* in communication with a lower portion of the lubricator, and a plunger arrival sensor 371*c*. Each sensor 371*a-c* may be in data communication with the controller 221 to facilitate control of production thereby. The plunger lift system 230 may further include a pressure transducer (not shown) on the wellhead in fluid communication with an annulus formed between the casing 232 and the production tubing 237 and in data communication with the controller 221.

On the opposite side of the longitudinal bore 355, the catcher assembly 356 may be coupled to the lower body section 351 to catch and maintain the plunger 242 in the lubricator 231. The catcher assembly 356 may be operated to retain the plunger 242 in the lubricator 231. Catching the plunger 242 allows an operator to retrieve the plunger 242 during the plunger lift operation for inspection, removal, repair, and/or replacement. The catcher assembly 356 may also be used to at least temporarily halt the operation of the plunger lift system 230 by ceasing movement of the plunger 242. The nut 392 and the upper body section 350 may be removed to allow access to the plunger for removal from the lubricator 231.

The lubricator 231 also includes a striker assembly 357 disposed in an upper portion thereof. The striker assembly 357 is adapted to halt the movement of a plunger 242 during a plunger up stroke. The striker assembly 357 may include a dampener housing 358, a dampener support rod 359, a choke plate 361, and hydraulic fluid 471. An upper end of the dampener support rod 359 may be connected to the upper body section 350. The connection between the dampener support rod 359 and the upper body section 350 may be by a threaded coupling formed at an upper end of the rod and a threaded coupling formed in a lower surface of the cap portion 360. The choke plate 361 may be connected to a lower end of the dampener support rod 359, such as by threaded couplings. The choke plate 361 may be disposed within a bore of the dampener housing 358. The dampener support rod 359 may extend through a passage 362 formed through an upper cap portion 363 of the dampener housing 358. Seals, such as O-rings, may be positioned at the passage 362 to form a fluid-tight seal between the dampener housing 358 and the dampener support rod 359.

The dampener housing 358 may be positioned on a shoulder 365 extending inwardly into the bore 355 from the lower body section 351. The shoulder 365 may limit the downward travel of dampener housing 358. The striker assembly 357 may further include a spring 366 disposed between a lower surface of the choke plate 361 and a lower shoe portion 367 of the dampener housing 358. The spring 366 may be a compression spring operable to bias the dampener housing 358 into engagement with the shoulder 365. The dampener housing 358 has a cylindrical shape adapted to match the internal shape of the lubricator 231. A lower, external surface 369 of the shoe portion 367 acts as a contact surface for a plunger, and may optionally include a coating thereon, such as an elastomeric coating, to facilitate cushioning between the dampener housing 358 and the plunger 242.

Figure 4A:
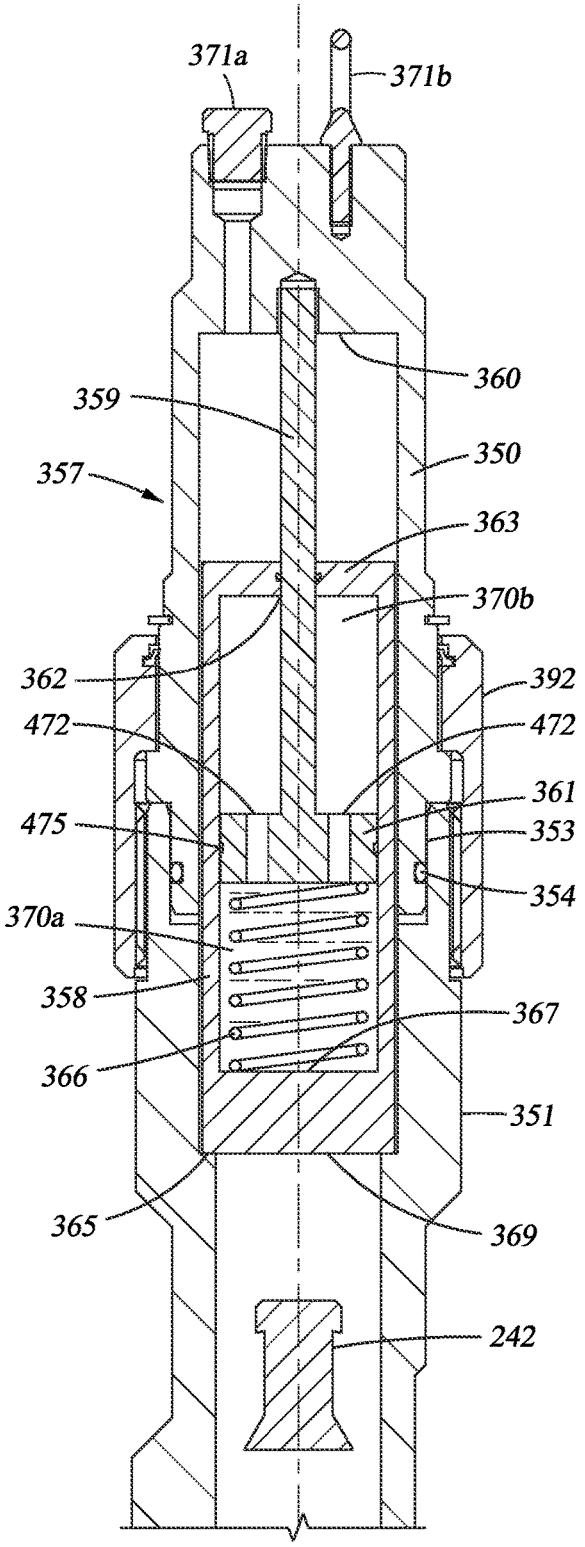
FIGS. 4A and 4B illustrate operation of the lubricator.
Figure 4B:
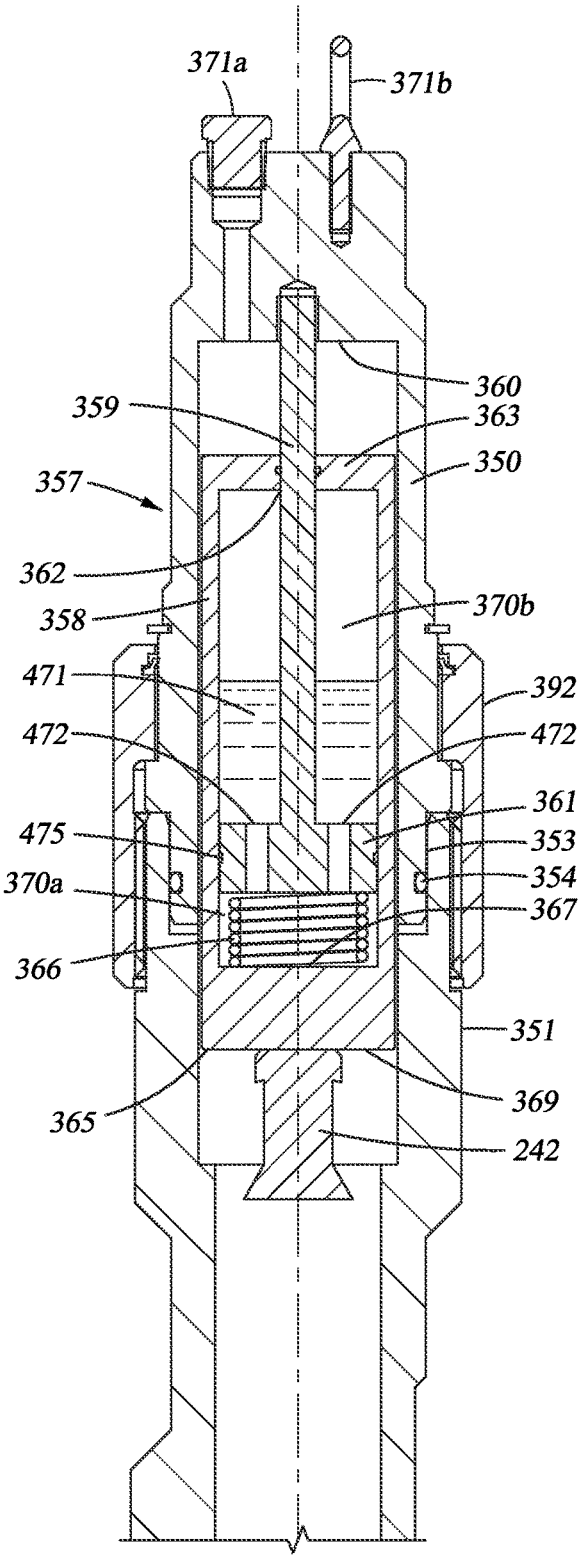

The dampener housing 358 may be longitudinally movable relative to the lubricator housing 350, 351 between a ready position (shown and FIG. 4A) and a stroked position (FIG. 4B). The choke plate 361 may partition the bore of the dampener housing 358 into an upper chamber 370*b* and a lower chamber 370*a*. The hydraulic fluid 471 may fill the lower chamber 370*a* in the ready position. The upper chamber 370*b* may include some hydraulic fluid 471 in the ready position and a pocket of gas to account for volume displaced by the rod 359 entering the upper chamber during movement to the stroked position. The hydraulic fluid 471 may be a liquid, such as water, antifreeze, a mixture of water and antifreeze, refined oil, or synthetic oil. During movement between the positions, the hydraulic fluid 471 is transferred back and forth between the chambers 370*a,b*.

A seal, such as an O-ring 475, may be disposed around the choke plate 361 between the dampener housing 358 and the choke plate 361 to facilitate movement of the hydraulic fluid 471 through the orifices 472 rather than between the dampener housing 358 and the choke plate 361. Additionally, a seal, such as an O-ring, may be disposed in the dampener housing 358 at the passage 362 to prevent escape of hydraulic fluid 471 from the dampener housing 358 as the dampener housing 358 travels along the dampener support rod 359. A space may be formed between the cap portions 360, 363 in the ready position for receiving the dampener housing 358 in the stroked position. Alternatively, the spring 366 may be disposed in the space formed between the cap portions 360, 363. An interface between the lubricator body 350, 351 and the dampener housing 358 may be unsealed for pressure equalization.

FIGS. 4A and 4B illustrate operation of the striker assembly 357. FIG. 4A illustrates the striker assembly 357 prior to dampening of the plunger 242. FIG. 4B illustrates the striker assembly 357 having halted the upward movement of the plunger 242. During operation, the plunger 242 travels up the bore 355 and contacts the surface 369 of the dampener housing 358. The plunger 242 drives the dampener housing 358 upward, reducing the volume of the lower chamber 370*a* and increasing volume of the upper chamber 370*b*. As the dampener housing 358 is moved upward, the hydraulic fluid 471 stored in the lower chamber 370*a* is forced through one or more orifices 472 of the choke plate 361. The resistance of the fluid forced through the orifices 472 dissipates the kinetic energy of the plunger 242.

The diameters of the orifices 472 disposed through the choke plate 361 are selected to facilitate dissipation of the plunger energy as the hydraulic fluid 471 is forced therethrough. Rather than the spring 366 absorbing the energy of the plunger 242, as is done in the prior art lubricator 100, the striker assembly 357 dissipates the energy of the plunger 242 using the hydraulic fluid 471. The orifices 472 can be sized to meter the rate of hydraulic fluid forced through the choke plate, thereby facilitating control of the rate of deceleration of the plunger 242, as well as the distance required to stop upward movement of the plunger 242. The orifices 472 may have equal diameters, or may have different diameters.

The spring 366 may be located in the lower chamber 370*a* and resets striker assembly 357 to the ready position after receiving the plunger 242. The spring 366 is compressed by the upward movement of the dampener housing 358. Once upward movement of the plunger 242 is halted, the spring 366 expands against the choke plate 361 to move the dampener housing 358 into position against the shoulder 365. As the spring 366 expands, the dampener housing 358 is moved relative to the choke plate 361, hydraulic fluid 471 drains through the orifices 472 back into the lower chamber 370*a* from the upper chamber 370*b*. The striker assembly 357 is again ready to stop plunger travel during a subsequent upstroke of the plunger 242.

Because a majority of the force of the plunger 242 is absorbed by the hydraulic fluid 471, maintenance, inspection, and/or replacement of the spring 366 is reduced. While the spring 366 is located in the striker assembly 357, the spring 366 is not the primary resistance against the plunger 242, and thus, has a significantly longer useful life than springs utilized to stop the movement of the plunger 242. The spring 366 may absorb less than 10 percent of the energy of the plunger 242, such as five percent, two percent, or less. The striker assembly 357 provides a more gradual dissipation in kinetic energy as compared to the conventional spring 109 used to cushion the plunger 242, but at the same time is not as easily damaged, thereby reducing lubricator downtime.

Figure 5:
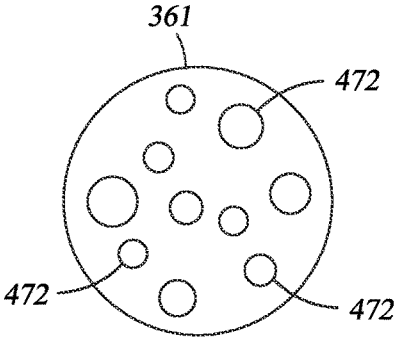
FIG. 5 illustrates a bottom perspective view of a choke plate.

FIG. 5 illustrates a bottom perspective view of a choke plate 361. The choke plate 361 includes the orifices 472 disposed therethough. The number and size of orifices 472 may be increased or decreased to adjust the shock absorbing effect of the striker assembly 357. For example, fewer or small orifices 472 may result in a more abrupt stop of a plunger 242, while larger or more orifices 472 may create a relatively slower or more cushioned stop of the plunger.

Although embodiments described above are explained in terms of "upper," "lower," "up-stroke," "down-stroke," and similar directional terms, these terms are used only for illustration purposes. As such, the lubricator, its components, and its methods or operation are not limited to the vertical orientation, but components (and their movements) may be horizontally oriented or positioned in any angled orientation between vertical and horizontal. Additionally, embodiments of the lubricator of the present invention and its components and methods of operation are not limited to components positioned or to components moving in the upper and lower directions; rather, these directional terms are merely used herein to indicate positions of components and movement of components relative to one another.

While the foregoing is directed to embodiments of the present invention, other and further embodiments of the invention may be devised without departing from the basic scope thereof, and the scope thereof is determined by the claims that follow.

What is claimed is:

1. A lubricator for use in a plunger lift system, comprising:

a tubular body having an outlet formed through a wall thereof and a bore therethrough, the bore closed at an end thereof; and a striker assembly disposed within the bore, the striker assembly comprising:

a dampener housing longitudinally movable relative to the tubular body between a ready position and a stroked position;

a choke plate disposed in the dampener housing, separating a bore of the housing into an upper hydraulic chamber and a lower hydraulic chamber, and having one or more orifices formed therethrough; and a dampener support rod connecting the choke plate to the tubular body, wherein the choke plate is fixed in position and the dampener housing is adapted to move relative to the choke plate during operation;

wherein the orifices are sized to dissipate kinetic energy of a plunger striking a lower end of the dampener housing and moving the dampener housing from the ready position to the stroked position.

2. The lubricator of claim 1, wherein the striker assembly further comprises a return spring disposed in the lower hydraulic chamber, the lower hydraulic chamber adapted to hold a fluid therein when the dampener is in the ready position.

3. The lubricator of claim 2, wherein the return spring biases a bottom end the dampener housing against a shoulder of the tubular body.

4. The lubricator of claim 1, wherein the striker assembly further comprises hydraulic fluid filling at least the lower hydraulic chamber, wherein moving the dampener from the ready position to the stroked position causes the hydraulic fluid to be transferred from the lower hydraulic chamber to the upper hydraulic chamber through the choke plate.

5. The lubricator of claim 1, wherein the choke plate has a plurality of the orifices and each orifice has the same diameter.

6. The lubricator of claim 1, wherein the choke plate has a plurality of the orifices and at least some of the orifices have different diameters.

7. The lubricator of claim 1, wherein the dampener housing has a passage formed in a cap portion thereof and the dampener support rod extends through the passage.

8. The lubricator of claim 1, wherein the outlet is an upper outlet and the body further has a lower outlet formed through a wall thereof.

9. The lubricator of claim 8, further comprising a catcher disposed between the outlets and operable to engage the plunger.

10. The lubricator of claim 1, further comprising a pressure transducer in fluid communication with the bore.

11. The lubricator of claim 1, wherein the spring is in contact with the choke plate.

12. The lubricator of claim 1, further comprising a shoulder formed on a surface of the bore and adapted to contact a lower surface of the dampener housing to limit the travel of the dampener housing.

13. The lubricator of claim 1, further comprising a seal positioned at the interface of the dampener support rod and the dampener housing.

14. The lubricator of claim 1, wherein moving the dampener from the ready position to the stroked position causes the hydraulic fluid to be transferred from the lower hydraulic chamber to the upper hydraulic chamber through the choke plate.

15. A plunger lift system, comprising:

the lubricator of claim 1;

a tubing string for connection to the lubricator and for extension to a hydrocarbon bearing reservoir;

an automated valve for connection to the outlet;

an electronic controller for operation of the automated valve; and the plunger for reciprocation within the tubular string.

16. A method for producing hydrocarbon bearing reservoir using the plunger lift system of claim 15, comprising:

loading fluid above the plunger while the plunger is at a bottom of the tubing string; and opening the automated valve after loading the fluid, thereby causing the plunger to move up the tubular string and strike the dampener housing.

* * * * *